United States Patent [19]

Gardner et al.

[11] 4,373,451

[45] Feb. 15, 1983

[54] APPARATUS AND METHOD FOR FEEDING PULVERIZED SOLID FUEL TO A BURNER

[75] Inventors: Kenneth L. Gardner, Riverside; Edward Gootzait, Lewisburg; Edward T. Maciejewski, Catawissa; Donald L. Fisher, Milton, all of Pa.

[73] Assignee: Kennedy Van Saun Corporation, Danville, Pa.

[21] Appl. No.: 251,498

[22] Filed: Apr. 6, 1981

[51] Int. Cl.[3] ..... F23K 3/00

[52] U.S. Cl. ..... 110/101 CC; 110/347; 414/21

[58] Field of Search ..... 110/101 CC, 101 CB, 110/101 CF, 101 R, 327, 106, 347; 414/21

[56] References Cited

U.S. PATENT DOCUMENTS

| | | | |
|---|---|---|---|
| 642,298 | 1/1900 | Cooper | 110/101 CF |
| 3,220,567 | 11/1965 | Bothmer et al. | 414/21 |
| 4,074,816 | 2/1978 | Legille | 414/21 |
| 4,250,816 | 2/1981 | Angevine et al. | 110/106 X |
| 4,311,102 | 1/1982 | Kolze et al. | 110/101 CC X |
| 4,331,084 | 5/1982 | Fitch et al. | 110/101 CC X |

FOREIGN PATENT DOCUMENTS

| | | | |
|---|---|---|---|
| 338362 | 11/1930 | United Kingdom | 110/101 CC |

*Primary Examiner*—Edward G. Favors

*Attorney, Agent, or Firm*—Brumbaugh, Graves, Donohue & Raymond

[57] ABSTRACT

An apparatus and method for feeding pulverized solid fuel to one or more burners of a kiln in which batches of the pulverized fuel are weighed and metered into air conduits at a rate controlled by the weight of the batch for the supply of an air-fuel mixture to the burners.

12 Claims, 2 Drawing Figures

APPARATUS AND METHOD FOR FEEDING PULVERIZED SOLID FUEL TO A BURNER

Figure 1:
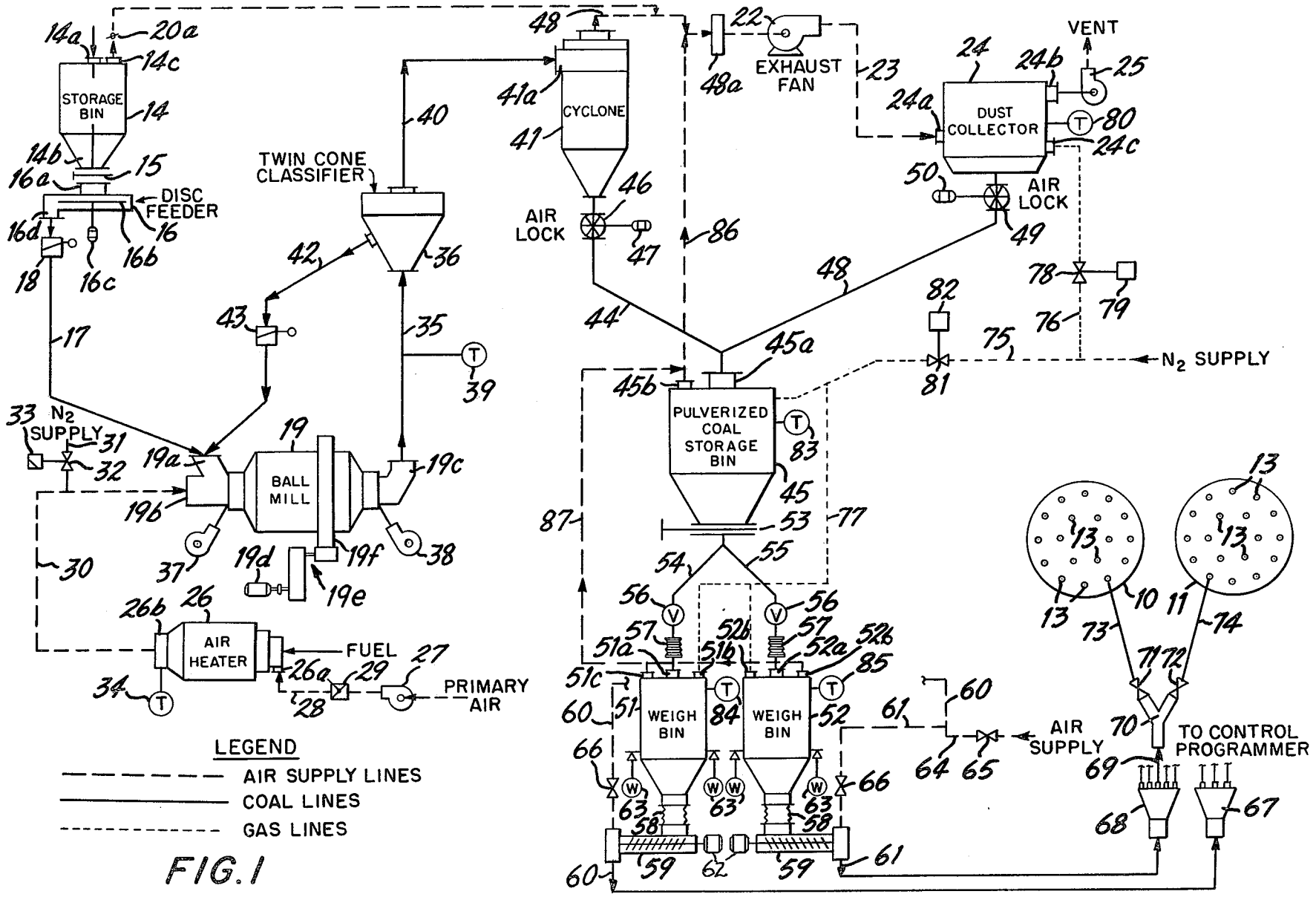

This invention relates to an apparatus and method for pulverizing solid fuel and feeding the pulverized solid fuel to the burner of a kiln. Although having broader application, the present invention is particularly applicable to the use of pulverized solid fuels for shaft kilns, such as coal fired parallel flow regenerative kilns for calcining limestone of the type described in the Schmid et al. U.S. Pat. No. 3,074,706, issued Jan. 22, 1963, and improvements in the apparatus and method described in the pending Gootzait et al. application, Ser. No. 126,310, filed Mar. 3, 1980 U.S. Pat. No. 4,337,030.

In the operation of shaft kilns for calcining limestone, the quantity and distribution of the fuel supplied to the burners must be controlled accurately for the kiln to operate properly and they must be controlled with a high degree of precision for the kiln to achieve and maintain a quality of product comparable to that produced in rotary kilns which consume fuel at a far greater rate than shaft kilns. Shaft kilns do not operate properly when fuel is supplied in uneven, excessive or deficient quantities to the burners of the shaft kiln. An excessive supply of fuel to the burners will produce excessively high temperatures, causing the lime in the kiln to stick together or even fuse, preventing the material from flowing uniformly through the kiln and perhaps stopping the flow entirely, with the result that the kiln has to be shut down and cleaned before it can be started up again. On the other hand, if the supply of fuel is deficient, the failure to heat the limestone to the calcining temperature may produce an unusable product.

It was not a particularly difficult problem to supply liquid and gaseous fuels to the burners at the desired rate and distribution because such fuels are relatively easy to meter and handle. However, the high cost and relatively short supply of liquid and gaseous fuels has created considerable interest in utilizing the more plentiful and less expensive solid fuels for firing shaft kilns, and the handling and metering of solid fuels presents far greater problems than those encountered in handling and metering liquid and gaseous fuels.

The principal object of the present invention is to provide an improved apparatus and method of processing, metering and supplying solid fuel to the burners of a kiln. This is accomplished in the present invention by an apparatus and method in which the pulverized solid fuel is subdivided into batches which are separately weighed and metered into an air conduit for supply to the burner at a rate controlled by the weight of each batch. In one embodiment of the invention, the batches are distributed to bins in which they are weighed and then fed to the air supply conduit at metered rates determined by the weight of the respective batch. In another embodiment of the invention, the batches are distributed to conveyors on which they are weighed and fed to the air supply conduit at metered rates determined by the weight of the batch on the respective conveyor. In either case, metered supplies of fuel can be introduced into the air stream from the multiple batch weighers and supplied at the desired rates and distribution to the burners of the kiln. Moreover, in the case of multiple shaft kilns, it is possible to supply the same metered amounts of fuel from the same metered source to correspondingly located burners of the shafts so that the distribution of fuel to corresponding burners is uniform and distribution to other burners can be varied if it is desirable to do so.

Figure 2:
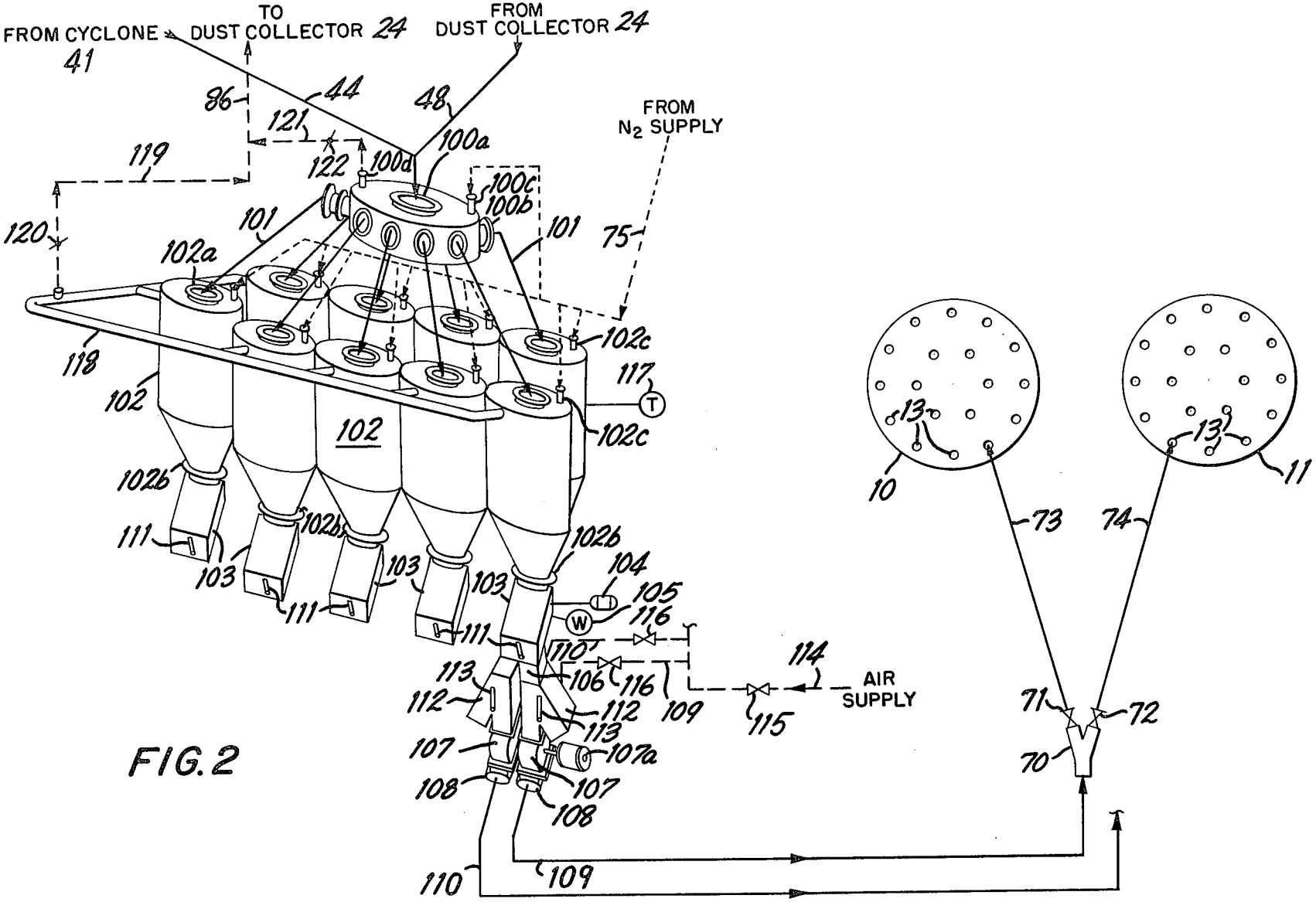

These and other features of the present invention will be apparent and more fully understood by reference to the detailed description which follows and to the accompanying drawings, in which:

FIG. 1 is a schematic flow chart showing the apparatus and method of the present invention, and FIG. 2 is a schematic flow chart of an alternative embodiment of the invention.

In the system shown in FIG. 1 of the drawings, coal or other pulverized solid fuel is supplied alternately to a pair of kilns 10 and 11, for example, of the type described in the above-identified Schmid et al. patent and the above-identified Gootzait et al. application. The kilns 10, 11 each contain a plurality of burners 13 arranged in spaced apart relationship. The limestone or other product to be treated in the kilns is introduced into a common inlet and is alternately charged at intervals into the kilns 10 or 11. As shown, each kiln has twelve burners arranged around the outer periphery of the kiln and six interior burners, a total of eighteen, to which fuel must be supplied in metered amounts distributed to achieve relatively uniform heating of the limestone or other material heated within each kiln.

The coal is supplied to the kilns from a bin 14. The coal is fed into the bin through a upper inlet **14*a* and discharged from a tapered lower outlet 14*b* through a gate 15 into the inlet 16*a* of a rotary disc feeder 16. The rotary disc feeder contains a rotary disc 16*b* driven by a motor 16*c*. The disc displaces the coal outwardly to a discharge outlet 16*d*. The rotary disc feeder 16 discharges the coal at a prescribed rate determined by the speed of rotation of the disc through a conduit 17 which supplies the coal to the inlet 19*a* of a ball mill 19 in which the coal is pulverized in the presence of heated air. The conduit 17 contains an air lock 18, and the coal flows through the conduit 17 by gravity. The speed of the rotary disc feeder is controlled by the amount of coal in the ball mill which, in turn, regulates the speed at which the motor 16*c* drives the disc 16*b***.

The coal dust is discharged by an exhaust fan 22 from the storage bin 14 through an outlet **14*c* at the upper end thereof. The fan communicates with the outlet 14*c* through conduits 20 and 48 containing dampers 20*a* and 48*a*, respectively. The exhaust fan 22 discharges the coal dust through a conduit 23 to the inlet 24*a* of a dust collector 24. The dust collector salvages usable coal product and vents the air through an outlet 24*b* which communicates with the intake of a vent fan 25**.

The heated air is supplied to the ball mill 19 by an air heater 26 to which primary air and fuel are supplied. The primary air is supplied to an inlet **26*a* of the heater by a blower 27 through a conduit 28 containing a control valve 29. The heated air is discharged from the heater by an outlet 26*b* which is connected by a conduit 30 to the air inlet 19*b*** of the ball mill.

The heated air supplied to the ball mill can be tempered to prevent combustion or explosion of the air-fuel mixture by supplying nitrogen or other inert gas into the conduit 30 through a conduit 31 containing a valve 32 controlled by a valve positioner 33. The valve positioner 33 is controlled, inter alia, by a temperature sensing means 34 in communication with the outlet **26*b* of the air heater. If the temperature of the air supplied by the conduit 30 to the ball mill becomes too high, the valve positioner 33 will control the valve 32 to supply tempering gas to the conduit 30** to prevent combustion or explosion.

The ball mill 19 pulverizes the coal as the coal is fed through it from the inlet 19*a* to the discharge 19*c*. The ball mill housing is rotated about its longitudinal axis by a motor 19*d* through a gear train 19*e* and a gear 19*f* which extends around the outer periphery of the ball mill housing.

The pulverized coal is lifted from the discharge 19*c* of the ball mill through a conduit 35 to an elevated twin cone classifier 36 which separates the finer and coarser pulverized coal. If the heated air from the heater 26 is not capable of lifting the pulverized coal to the classifier 36, supplementary air for lifting the product from the mill to the classifier may be provided by an air pump 37 at the upstream end of the ball mill and an air pump 38 at the downstream end thereof. A temperature sensing device 39 in the conduit 35 also controls the valve positioner 33 to admit additional tempering gas to the ball mill when the temperature in the conduit becomes too high.

The finer pulverized coal product is discharged from the top of the classifier 36 through a conduit 40 to the upper tangential intake 41*a* of a cyclone 41 which separates the dust-laden air from the pulverized coal product. The coarser coal separated in the classifier 36 is returned by gravity through a conduit 42 containing an air lock 43 to the coal inlet 19*a* of the ball mill for reprocessing therein.

The pulverized coal product is discharged from the lower end of the cyclone 41 and passes by gravity through a conduit 44 to the inlet 45*a* of a storage bin 45 for the pulverized coal. The conduit 44 contains a rotary air lock 46 driven by a motor 47 to permit the passage of the pulverized coal to the storage bin while at the same time preventing any back flow through the conduit 44. The coal dust is discharged from the upper end of the cyclone 41 through the conduit 48 and the damper 48*a* by the blower 22 which, as described above, supplies the coal dust to a dust collector 24 for separating coal product from ventable air. The coal product is fed by gravity through a conduit 48 to the storage bin 45. The conduit 48 contains a rotary air lock 49 driven by a motor 50.

The pulverized coal is fed from the storage bin 45 and subdivided into separate batches which are fed by gravity to a plurality of weigh bins 51, 52, the former supplying coal to the inner burners of the kilns 10, 11 and the latter supplying pulverized coat to the outer burners of the kilns 10, 11. In this way the pulverized coal may be supplied in uniform amounts of all of the burners or it may be supplied in different quantities to the inner and outer burners, as desired.

The pulverized coal is discharged from the lower end of the storage bin 45 through a gate 53 and then through separate conduits 54, 55 to the weigh bins 51, 52, respectively. The conduits 54, 55 each contain hydraulically actuated metering gates 56 and flexible connections 37 which permit the weigh bins 51, 52 to be displaced relative to the storage bin 45. The pulverized coal discharged by gravity from the lower ends of the bins 51, 52 passes through flexible connections 58 to screw type feeders 59, the screw feeder of the weigh bin supplying the pulverized coal product through a dischargehead into an air conduit 60 and the screw feeder of the weigh bin 52 supplying the pulverized coal product through a dischargehead into an air conduit 61. The flexible connections 57, 58 permit the weigh bins 51, 52 to be displaced relative to the bin 45 and the screw feeders 59.

The screw feeders 59 are driven by variable speed motors 62 which are separately controlled by a weight signal from the respective bin 51, 52. Toward this end, the displaceable weigh bins are weighed by weight detectors 63 and the weight of each bin controls the speed of the respective variable speed motor 62 and screw feeder 59 which it drives. If the rate of weight loss of the respective bin decreases, indicating that the screw feeder is not supplying enough fuel to the burners, the motor will drive the screw feeders faster to increase the rate of supply of pulverized fuel. Similarly, if the rate of weight loss of the respective bin increases, the rate of the supply of fuel to the burners will be decreased. The rates of supply of fuel from each bin can be separately controlled so that the inner and outer burners of each kiln can be supplied with the same or different amounts of fuel.

Air is supplied to the conduits 60, 61 from a common air supply conduit 64 containing a control valve 65. The air supply conduit 64 communicates with the conduits 60, 61 upstream of the points at which the pulverized coal is metered therein. The conduits 60, 61 each contain a control valve 66 upstream of the points of introduction of the pulverized coal.

The conduit 60 supplies the air-fuel mixture to a flow divider 67 which supplies the air and pulverized coal through a plurality of conduits to all of the inner burners of the kilns 10, 11. The conduit 61 supplies the air-fuel mixture to a flow divider 68 which supplies the air and pulverized coal through a plurality of conduits to all of the outer burners of the kilns. Thus, for example, each of the conduits 69 from the flow divider 68 passes through a divider gate 70 which connects the conduit 69 through valves, 71, 72 to a pair of conduits 73, 74, respectively, which conduct the air-fuel mixture to corresponding burners of the kilns 10, 11. The valves 71, 72 are programmed to operate alternately so that one valve is open when the other is closed and vice versa in order to operate the kilns 10, 11 alternately. Auxiliary air can be supplied, if necessary to support combustion, to the conduits 73, 74.

A source of inert gas, such as nitrogen, is supplied by a conduit 75 to prevent combustion of explosion in the dust collector 24, the storage bin 45 and the weigh bins 51, 52 in the event that the temperature should increase above a critical level. A conduit 76 connects the conduit 75 to an inert gas inlet 24*c* of the dust collector 24. A conduit 77 also connects the conduit 75 to the inert gas inlets 51*b*, 52*b* of the weigh bins 51, 52, respectively. The supply of inert gas through the conduit 76 to the dust collector is controlled by a valve 78 regulated by a valve positioner 79. The valve positioner is controlled by a temperature sensing device 80 communicating with the interior of the dust collector.

Downstream of the junction with the conduit 76, the conduit 75 contains a control valve 81 which controls the supply of inert gas to the storage bin 45 and the weigh bins 51, 52. The valve 81 is controlled by a valve positioner 82 which, in turn, is responsive to a temperature sensing device 83 communicating with the interior of the storage bin and temperature sensing devices 84, 85 in communication with the interiors of the weigh bins 51, 52, respectively. If the temperature of the dust collector, coal storage bin or weigh bins becomes too high, a supply of inert gas is released into the units so as to prevent combustion or explosion.

The storage bin 45 is provided with a vent 45b which communicates through a vent line 86 with the exhaust fan 22. The weigh bins 51, 52 are also provided with vents 51c, 52c, respectively, which are connected by a common vent line 87 with the vent line 86. The vent line 86 exhausts air through the dust collector 24.

Another embodiment for controlling the supply and distribution of pulverized coal in measured amounts to the burners of the kilns 10 and 11 is shown in FIG. 2 of the drawings. In this embodiment the pulverized coal discharged from the cyclone 41 passes by gravity through the conduit 44 to the inlet 100a in the top of a distributor 100 having a plurality of outlets 100b emanating from the outer circumference of the distributor. Each of the outlets 100b is connected by a conduit 101 to a different storage bin 102 which stores a quantity of pulverized coal, for example, an eight-hour supply, for one or more corresponding burners of each of the kilns 10, 11.

In the particular embodiment shown in FIG. 2, each of the kilns contains eighteen burners, so that nine storage bins 102 are provided, each supplying two corresponding burners of each kiln.

The storage bins 102 have inlets 102a at their upper ends and lower outlets 102b at their lower ends which discharge into batch weigh conveyor feeders 103. Each of the batch weigh feeders 103 is a belt-type conveyor feeder driven by a variable speed motor 104 controlled by a weight detector 105 which can be adjusted to supply the pulverized coal at a predetermined rate. The weigh feeder 103 discharges the pulverized coal at the adjusted rate through a mechanical splitter 106 which discharges from each storage bin 102 two uniform and controlled streams of pulverized coal. The pulverized coal passes from the splitter 106 through rotary air locks 107 driven by a motor 107a into venturis 108 in the air conduits 109, 110 which carry the air-fuel mixture to the burners of the kilns.

A valve 111 is provided at the discharge end of each weigh feeder to adjust the flow into the splitter. The splitter is provided with a pair of sampling diverters 112 which are normally closed by valves 113, but the valves 113 can be adjusted to divert the flow of pulverized coal from the kiln to the sampling diverter in the event that it is desirable to cut off the flow of fuel to the kilns or to divert samplings for inspection.

Air is supplied to the conduits 109, 110 from an air supply conduit 114 containing a control valve 115. The air supply conduit 114 communicates with the conduits 109, 110 upstream of the points at which the pulverized coal is introduced therein. The conduits 109, 110 each contain a control valve 116 upstream of the points of introduction of the pulverized coal.

The conduits 109, 110 each supply the air-fuel mixture to a flow divider gate 70 which, in turn, supplies the air-fuel mixture alternately to corresponding burners of the kilns 10, 11.

As in the embodiment described in FIG. 1, a source of nitrogen or other inert gas is supplied to the distributor 100 and the storage bins 102 by a conduit 75 controlled by a temperature sensing means 117 which senses the temperature in the interiors of each of the storage bins 102. The inert gas is supplied through a manifold to the inert gas inlet 100c at the top of the distributor 100 and to the inert gas inlet 102c at the top of each of the storage bins.

The upper regions of all of the storage bins 102 also communicate with a vent manifold 118 which, in turn, is connected through a conduit 119 containing a damper 120 to the conduit 86 which carries the coal dust back to the dust collector 24. The distributor also contains a coal dust vent 100d which is connected by a conduit 121 containing a damper 122 with the conduit 86.

In a typical embodiment of the invention for a kiln having an output of 400 tons of calcined limestone per day, the pulverized coal is supplied at the rate of 5.25 tons per hour to generate about 70 million BTU per hour. Approximately 390 lbs. per hour of pulverized coal with about 40 scfm air is supplied to each burner through the conduits 60, 61, 109, 110, with supplementary air supplied directly to the conduits 73, 74. The kiln generates approximately 3.64 million BTU per short ton of coal.

The invention has been shown and described in preferred forms and by way of example, and many variations and modifications can be made therein without departing from the spirit of the invention. The invention should not be construed as limited to any specified form or embodiment, except in so far as such limitations are expressly set forth in the claims.

We claim:

1. An apparatus for feeding pulverized solid fuel to the burners of a kiln comprising distributing means for distributing pulverized solid fuel into a plurality of fuel streams, means for weighing pulverized fuel in each stream, a plurality of air conduits for receiving pulverized fuel therein from said streams and supplying an air-fuel mixture to burners in different regions of the kiln and a driven fuel feed means for feeding the pulverized fuel from each stream to an air conduit at a rate controlled by the respective weighing means.

2. An apparatus as set forth in claim 1 in which the weighing means includes a weighing bin through which the pulverized solid fuel flows by gravity, means displaceably connecting the weighing bin with respect to the upstream distributing and downstream feeding means so that the weighing bin can be displaced in relation to the weight of the batch of pulverized solid fuel therein, weight detecting means, and means controlled by said weight detecting means for controlling the speed of operation of said feeding means.

3. An apparatus as set forth in claim 1 in which the weighing and feeding means include a driven conveyor for feeding a batch for pulverized fuel to the air conduit and means for driving the conveyor in relation to the weight of the batch of pulverized fuel on the conveyor.

4. An apparatus as set forth in claim 1 including means for pulverizing solid fuel in the presence of heated air, means for separating pulverized solid fuel and dust-laden air, a dust collector for separating the air and dust, a storage bin for receiving the pulverized solid fuel from the separator and from the dust collector, and means for supplying the pulverized solid fuel to the weighing means.

5. An apparatus as set forth in claim 4 including a burner for heating a source of air supplied to the pulverizing means, temperature sensing means to detect the temperature of the heated air and means responsive to the temperature sensing means for introducing an inert tempering gas for temperature control and to prevent combustion.

6. An apparatus as set forth in claim 1 including means for feeding pulverized solid fuel to said weighing means, temperature sensing means and means responsive to the temperature sensing means for introducing an inert tempering gas for temperature control and to prevent combustion.

7. An apparatus as set forth in claim 4 in which the separating means is elevated in relation to the pulverizing means so that the pulverized fuel is lifted from the pulverizing means to the separating means by the flow of air, temperature sensing means intermediate the pulverizing means and the separating means and means responsive to said temperature sensing means to introduce an inert gas to prevent combustion.

8. An apparatus as set forth in claim 1 in which the kiln contains a plurality of burners, some arranged in the outer periphery of the kiln and others arranged within the inner regions of the kiln and means for feeding the air-fuel mixture to burners of the inner and outer regions of the kiln from separate weighing means.

9. An apparatus as set forth in claim 1 including a venturi in the air conduit at the point at which the pulverized solid fuel is metered thereto and an air lock upstream of said venturi.

10. A method for feeding a pulverized solid fuel to the burners of a kiln comprising subdividing pulverized solid fuel into a plurality of fuel streams, weighing pulverized fuel in each stream, supplying an air-fuel mixture to the burners in different regions of the kiln through a plurality of air conduits to which pulverized fuel is supplied from said streams, and feeding the weighed pulverized fuel from each stream into an air conduit by a driven fuel feed means at a rate controlled by the weight of the pulverized solid fuel.

11. A method as set forth in claim 10 in which a batch of pulverized solid fuel is weighed in a bin upstream of the point at which the pulverized solid fuel is fed to the air conduit and in which the rate of feed of the pulverized solid fuel from the bin to the air conduit is controlled by the weight of the batch within the bin.

12. A method as set forth in claim 10 in which of pulverized solid fuel is weighed on a moving conveyor upstream of the point at which the pulverized solid fuel is introduced into the air conduit and in which the rate of speed of the conveyor is controlled by the weight of the fuel thereon.

* * * * *